US005440998A

United States Patent [19]

Morgan, IV et al.

[11] Patent Number: 5,440,998

[45] Date of Patent: Aug. 15, 1995

[54] PLASTIC PALLET ASSEMBLY AND METHOD

[75] Inventors: Robert L. Morgan, IV, Climax; Michael D. Monfore, Battle Creek, both of Mich.

[73] Assignee: Polycytek of Michigan, Inc., Battle Creek, Mich.

[21] Appl. No.: 191,855

[22] Filed: Feb. 3, 1994

[51] Int. Cl.[6] ..... B65D 19/00

[52] U.S. Cl. ..... 108/51.1; 108/901

[58] Field of Search ..... 108/51.1, 56.1, 901, 108/902; 206/386

[56] References Cited

U.S. PATENT DOCUMENTS

| | | | |
|---|---|---|---|
| 1,612,382 | 12/1926 | Lehman . | |
| 2,501,506 | 3/1950 | George . | |
| 3,602,157 | 8/1971 | Cohen | 108/51.1 |
| 3,878,796 | 4/1975 | Morrison . | |
| 4,359,948 | 11/1982 | Judy et al. . | |
| 5,031,776 | 7/1991 | Morgan . | |
| 5,058,746 | 10/1991 | Morgan . | |
| 5,170,722 | 12/1992 | Friesner et al. . | |

FOREIGN PATENT DOCUMENTS

| | | | |
|---|---|---|---|
| 2333811 | 3/1974 | Germany | 108/51.1 |
| 0648611 | 1/1951 | United Kingdom | 108/51.1 |

*Primary Examiner*—José V. Chen
*Assistant Examiner*—Gerald A. Anderson
*Attorney, Agent, or Firm*—Gordon W. Hueschen

[57] ABSTRACT

The invention is a plastic essentially rectangular modular pallet assembly, the parts of which are also modular, comprising front and rear vertical transverse stringer members and top and bottom horizontal longitudinal deckboard members having alternating longitudinally-extending flat strip areas and longitudinally-extending channels or concavities on the surfaces thereof, wherein the longitudinal flat strip areas and channels or concavities of the top and bottom surfaces of deckboard members lie in vertically opposed relation to each other, the stringers comprising, on upper and lower deckboard-abutting surfaces, integral deckboard fastening studs, top and bottom deckboard members having apertures therein in flat surface strip areas thereof near the ends thereof which are adapted to receive the deckboard fastening studs, the deckboard fastening studs being received in the apertures and secured therein, the front and rear stringers of the pallet as well as sides of the pallet having openings adapted to receive the prongs of a lift truck or pallet jack.

14 Claims, 7 Drawing Sheets

PLASTIC PALLET ASSEMBLY AND METHOD

FIELD OF INVENTION

The field of invention is plastic pallets or portable platforms such as those utilized in the stacking and handling of shipping cases and other articles. Such structures are designed for use with trucks or mechanical lifting aids having lifting bars or tongues which project into position beneath the pallets to lift them and their loads either for transportation or for stacking in warehouses, railroad freight cars, ships, aircraft, or motorway trucks.

According to the American National Standard, "Definitions and Terminology Covering Pallets and Related Structures" (ASME MH1.1.2-1989), and published by The American Society of Mechanical Engineers, the pallet(s) of the present invention may in some embodiments also be referred to as a: "Stringer Design—Partial Four-Way Entry, Double Deck Pallet."

BACKGROUND OF THE INVENTION

The present standardization of pallets used in the unit-load method of assembling, stacking, storing, handling, and transporting materials and products originated from the interconnecting nature of pallet usage. The great variety of pallet sizes and constructions that previously existed restricted their movement through manufacturing and distribution channels. This variety was the result of each pallet constructor and user treating pallet design and use as an individual problem to be best solved by locally-expeditious means. In time, a more comprehensive application of the unit-load method of assembling, stacking, storing, handling, and transporting of commodities in domestic and international trade developed. Through evolution, some industries and military services have developed certain pallet standards to solve specific problems which are also existent with other users. Consequently, the resulting uniformity in construction of pallets established a pattern of value to all users.

As is well known, a pallet is customarily constructed of two courses of deck boards held in two parallel planes by parallel girder members, stringers, or runners in which the space provided between the two courses of deck boards is adapted to receive the forks of a lifting device. The lower deckboard is frequently referred to as a "footboard". The material most commonly used for constructing pallets for forklift use is lumber. However, lumber is not entirely satisfactory because of certain natural deficiencies, such as the limitation of natural resources, unstable supply, poor chemical resistance, ability to harbor and support vermin, fungus, and pathogens, and the necessarily-complicated manufacturing methods employed to produce dimensioned lumber and fabricated pallets. Metal and many forms of polymer or plastic pallets are also available. However, these have generally been single piece moldings or fabrications of complex design which have been expensive to produce.

The pallet(s) of the present invention may be used in full harmonious compatibility with wooden-constructed pallets as exist in present commerce. In applications where the transportation, handling, and storage systems have evolved to be specifically adapted for the standardized wood pallet dimension and performance characteristics, the pallet(s) of the present invention will equal or exceed all known service requirements. In industries such as food products, personal hygiene, fine chemicals, pharmaceuticals, printing, and others, where high standards of cleanliness and uniformity must be met, the pallet(s) of the present invention will excel.

Pallets of innumerable types, sizes and configurations have been known in the art. However, few are considered a dimensional and service replacement for the industry-accepted standard wood pallet design, and none of the pallets known to be available in the prior art have the advantages and features of the pallet of the present invention.

Searches were conducted in USPTO Class 108, Subclasses 52.1, 56.1, 901, and 902. The following issued U.S. patents may be considered to have some relevance to the present invention: U.S. Pat. No. 1,612,382 Lehman; U.S. Pat. No. 2,501,506 George; U.S. Pat. No. 3,654,877 Barrett; U.S. Pat. No. 3,878,796 Morrison; U.S. Pat. No. 4,359,948 Judy et al.; and U.S. Pat. No. 5,170,722 Friesner et al. None of the patents found in the search disclosed the type of pallet provided according to the present invention or any of the numerous significant advantageous features thereof. The same is to be said of the prior U.S. patents of Morgan, namely, U.S. Pat. No. 5,031,776 and 5,058,746, which are of a different type and intended for more complex containerization use.

THE INVENTION IN GENERAL

The present invention provides a plastic pallet construction comprising a plurality of pallet deck-board forming members in two layers and defining fork-receiving openings between said two layers, each said deck-board forming member having a length equal to the width of the pallet. Girder members, stringers, or runners, are located between the two layers of deck-board forming members and all girder members lie in the same plane, in a perpendicular orientation to the deck-board forming members, have a length equal to the length of the pallet, may also additionally have lift-fork entry openings, and are characterized by having fastening means provided therein which is adapted to connect the girder members with the pallet deck-board forming members in said two layers. In a preferred construction the pallet girders, stringers, or runners are formed of a fiber-reinforced thermoplastic material with fastening features molded into the stringer top and lower surfaces thereof. The molded fastening features protrude into and through corresponding apertures provided in the deck-board forming members so that protruding thermoplastic spikes or studs may be upset, deformed, or otherwise employed to provide integral fastening means. The deckboard forming members may be textured on their upper or load-contacting side to increase their coefficient of friction with the load and/or have similar molded or textured features on their lower or stringer-contacting side to increase the engagement integrity with the stringer, girder, or runner, as well as on the side of a deckboard designed to be floor engaging or to engage an underlying pallet, again to provide an enhanced coefficient of friction and engagement security with what lies beneath. In a preferred deck-board configuration, the deckboards are corrugated, with an asymmetric cross-section, and the corrugated peak and valley (or ridge and furrow) features of the deck boards mate and engage with the same features on vertically-adjacent pallet deckboards when placed in stacks, thereby increasing the integrity of a stack of pallets.

Pallets constructed of plastics of the type generally known in the present art can become damaged relatively easily. Usually the damage is localized in a small area but, because the pallet is of one or two-piece construction, the entire pallet often has to be scrapped because it cannot be repaired as with wooden pallets.

The plastic pallet(s) of the present invention provide a design and assembly system to satisfy the now-evolved standard pallet sizes and service requirements. In accomplishing this end, an object of the present invention is to provide an improved construction for a plastic pallet which will be less complex in design and therefore less expensive to produce then currently known designs, while at the same time providing the capability of being repaired in situations of localized damage due to the modular nature thereof.

The design features of the pallet(s) of the present invention allow all the customization and assembly flexibility which is normally found in a wood-constructed pallet and simultaneously also allow the use of the newer plastic engineering materials to their respective maximum design advantages.

The pallet design of the present invention is specifically adapted to be employed with shrink and stretch film methods of load stabilization as well as with the conventional metal and plastic-strapping methods of unit-load constraint.

The plastic pallet(s) of the present invention may be produced from a variety of materials by any method known in the plastics forming art, e.g., cast or extruded or molded plastics, whether thermosetting or thermoplastic, whether foamed or solid or containing reinforcements. The pallet components can also be produced from metals, whether fabricated or extruded. Wood and fiber materials whether organic or inorganic can also be molded with proper binding agents, as known in the art, to provide strong but relatively lightweight pallet members. If desired, a stressed-skin fabricated structure may be employed for pallet components, using skin sheets of wood, plywood, plastic, cardboard, fiberboard, paperboard, or corrugated paperboard over a core of foamed or fabricated honeycomb plastic or other material, or the like, as is usual in such fabricated construction. Preferably, the pallet components are made of synthetic plastic material obtained by recycling plastic waste. The pallets can thus be formed of relatively heavy components but at a relatively low cost.

An upper load-bearing deck which may comprise a single sheet deck board or multiple deck boards allows the pallet top deck construction to vary to suit the intended use and product need. A single sheet of material, with or without openings, may be used in place of multiple individual deckboards. For example, a greater number of deck boards can provide an almost solid top deck to support heavy loads or bulk commodities in bags. Or, a lesser number of deckboards allows space for ventilation through the pallet and ventilation through and around goods stacked thereon. Such ventilation means can also be used to advantage when products which are chilled or deep-frozen or, conversely, to be heated, are transported on the pallets so that cooling air or heated air can circulate through the loaded space and alongside the product. Moreover, the ability to regulate the flow of air by specific pallet construction, through a stack of pallets and loaded product, can be used to advantage in the introduction of controlled atmospheres during the transport and/or storage of many agricultural and other perishable products. For instance, products such as apples or bananas may be kept under controlled atmospheric conditions while in sea transport or for fumigation to control the unwanted introduction of pests or product spoilage. Other practical considerations for a pallet top deck board with slots or holes include the presence of additional attachment means and to provide openings for visual inspection of pallet loads.

OBJECTS OF THE INVENTION

Accordingly, it is an object of the present invention to provide a plastic pallet, for use with a fork lift or pallet jack, which has excellent bending strength characteristics and advantages in handling and maintenance. The pallet of the invention and its method of manufacture and assembly allows it to be of differing dimensions to conform with all known present standard pallet dimensions, as well as special dimensions as may be required by industry in the future, and to be compatible with existing pallet storage rack systems.

Another object of this invention is to provide a pallet which can be shipped to the using destination in a knocked-down state where it can be quickly erected into a full-functioning pallet utilizing automated pallet-making machinery. A pallet erecting machine, for manufacturing efficiency, can conveniently be located adjacent to the unit load-palletizing machine.

A further object of this invention is to provide a pallet for which the smallest possible quantities of material are employed and which can nevertheless support very heavy loads.

An additional object of this invention is to provide a pallet which, after a period of pallet use, when for instance seriously damaged, can be returned as a whole to a location for repair or for recovery of the plastic as scrap suitable for the production of new plastic products.

Still further objects are to provide a pallet made without the necessity of metallic fasteners or other incompatible materials to enhance the ability to reprocess, repair, or remanufacture the pallet expeditiously; to provide a pallet wherein the runners and deck boards are made of the same or dissimilar materials; and to provide a pallet the means for attachment of deck boards and runners allows the quick and convenient attachment and detachment of the deck boards for repair, reuse, or remanufacture, either in a reconstructed pallet or as feedstock in a polymer-reprocessing process.

Yet another object of the invention is to provide a novel manufacturing and pallet assembly method.

Still a further object of the invention is to provide a new and improved molded plastic pallet, for use with a forklift, having high bending strength characteristics which are remarkably superior to those of conventional plastic pallets and comparable to those of wooden pallets, and a method of producing the same.

These and other objects of the invention, as will hereinafter become clear to one skilled in the art from the ensuing discussion, are attained by providing a pallet and method according to the present invention.

SUMMARY OF THE INVENTION

The invention, then, inter alia, comprises the following, singly or in combination:

A plastic essentially rectangular modular pallet assembly, the parts of which are also modular, comprising front and rear vertical transverse stringer members and top and bottom horizontal longitudinal deck board members having alternating longitudinally-extending flat strip areas and longitudinally-extending channels or concavities on the surfaces thereof, wherein the longitudinal flat strip areas and channels or concavities of the top and bottom surfaces of deck board members lie in vertically opposed relation to each other, said stringers comprising, on upper and lower deck board abutting surfaces thereof, integral deck board fastening studs, top and bottom deck board members having apertures therein in the flat surface strip areas thereof near the ends thereof which are adapted to receive said deck board fastening studs, said deck board fastening studs being received in said apertures and secured therein, said front and rear stringers of said pallet having openings therein adapted to receive the prongs of a lift truck or pallet jack therein; such a pallet wherein the pallet has an intermediate stringer as well as front and rear stringers and wherein the sides of said pallet provide space for the insertion of the prongs of a lift truck or pallet jack therein between the stringers and between the top and bottom deck boards of said pallet; such a pallet wherein pallet stringers comprise apertures therein for weight reduction and for the reception of load-securing tiedown means therein; such a pallet wherein said stringers comprise, on upper and lower surfaces thereof and adjacent said integral deck board fastening studs, protuberances adapted to be received by longitudinally-extending channels or concavities in a deck board located between longitudinally-extending flat surface strip areas thereof, and wherein said protuberances are received in said cavities or channels; such a pallet wherein said protuberances comprise slots therein to facilitate fluid drainage from deckboards adjacent thereto; such a pallet wherein top and bottom deck board members have surfaces thereof in mating engagement with surfaces of stringer members by means of said integral deck board fastening studs in surfaces of said stringer members and stud receiving apertures in flat longitudinal surface areas of said deck board members; such a pallet wherein said mating engagement means includes protuberances adjacent said integral deck board fastening studs on stringer members and protuberance-receiving concavities or channels in the abutting surfaces of deck board members; such a pallet wherein protuberances on surfaces of said stringer members adjacent said integral deck board fastening studs comprise slot means to permit rain water or other liquid to drain from the surface of a deck board adjacent thereto; such a pallet wherein said studs are securely but releasably secured within said apertures so that the pallet can be readily disassembled; such a pallet wherein stringer members include flange members at upper corners thereof for supporting edges of deck boards secured thereto; such a pallet wherein a deck board is sufficiently dimensioned so that it comprises a full uninterrupted top or bottom pallet surface; such a pallet wherein a plurality of deck boards are employed as a top or bottom pallet surface and are located in spaced relation to each other; such a pallet wherein non-skid features are provided in flat longitudinal surface strip areas of deck board members; such a pallet wherein ridges are also provided in flat deck board surface strip areas to enhance air flow between a pallet deck board and a product supported thereon; such a pallet wherein similar pallets stacked upon each other are in mating engagement with each other by virtue of longitudinally-extending flat surface strip areas of deck board members engaged with and supported by longitudinally-extending concavities or channels in an abutting surface of longitudinally-extending deck board members of an underlying pallet; such a pallet wherein similar pallets stacked upon each other are in sliding engagement with each other by virtue of longitudinally-extending flat surface strip areas of deck board members supported by corresponding longitudinally-extending flat surface strip areas of deck board members of an underlying pallet; such a pallet wherein an upper corner of a stringer member is rounded and an adjacent longitudinal side edge of a longitudinally-extending deck board member is angled upwardly so as to provide a gap for the engagement therein of load-binding means or wrap; such a pallet wherein ridges are provided in vertical ends and pallet stringer members to provide a means of engagement of said stringer members with load-binding means or wrap; such a pallet wherein a deckboard is of non-uniform and asymmetric cross-sectional area so as to have a thinner longitudinally-extending flat strip on one side of the deckboard than on the opposite side of the deckboard.

Moreover, a plastic modular pallet-forming deckboard, adapted to become a horizontally-disposed longitudinal top or bottom pallet deck board member in a pallet formed therefrom, having alternating longitudinally-extending flat strip areas and longitudinally-extending channels or concavities on the surfaces thereof, wherein the longitudinal flat strip areas and channels or concavities of the top and bottom surfaces of deck board members lie in vertically opposed relation to each other, and having apertures therein in the flat surface strip areas thereof near the ends thereof which are adapted to receive deck board fastening studs on adjacent transverse stringer members of a pallet formed therefrom; and such a plastic modular pallet-forming deckboard wherein a deckboard is of non-uniform or asymmetric cross-sectional area so as to have a thinner longitudinally-extending flat strip on one side of the deckboard than on the opposite side of the deckboard.

Moreover, a plastic modular pallet-forming stringer, adapted to become a vertically-disposed transverse front, back, or intermediate pallet stringer member in a pallet formed therefrom, comprising on upper and lower surfaces thereof, which are adapted to abut deck boards in a pallet formed therefrom, integral deck board fastening studs, which are adapted to be received and secured in apertures in flat surface strip areas of deck boards near the ends of said deck boards in a pallet formed therefrom, said stringers having openings therein adapted to receive the prongs of a lift truck or pallet jack therein.

Finally, a method of providing a plastic modular pallet assembly comprising the step of providing a plastic modular pallet-forming deckboard adapted to become a horizontally-disposed longitudinal top or bottom pallet deck board member in a pallet formed therefrom, having alternating longitudinally-extending flat strip areas and longitudinally-extending channels or concavities on the surfaces thereof, wherein the longitudinal flat strip areas and channels or concavities of the top and bottom surfaces of deck board members lie in vertically opposed relation to each other, and having apertures therein in the flat surface strip areas thereof near the ends thereof which are adapted to receive deck board fastening studs on adjacent transverse stringer members of a pallet formed therefrom, and providing a plastic modular pallet-forming stringer adapted to become a vertically-disposed transverse front, back, or intermediate pallet stringer member in a pallet formed therefrom, comprising on upper and lower surfaces thereof, which are adapted to abut deck boards in a pallet formed therefrom, integral deck board fastening studs, which are adapted to be received and secured in apertures near the ends of said deck boards in a pallet formed therefrom, said stringers having openings therein adapted to receive the prongs of a lift truck or pallet jack therein, inserting said integral deck board fastening studs in said apertures in said deck boards, and securing said studs therein; and such a method wherein the deckboard provided is of non-uniform and asymmetric cross-sectional area so as to have a thinner longitudinally-extending flat strip on one side of the deckboard than on the opposite side of the deckboard.

PREFERRED EMBODIMENTS OF THE INVENTION

BRIEF DESCRIPTION OF THE DRAWINGS

The invention will be better understood by reference to the drawings, wherein.

DETAILED DESCRIPTION OF PREFERRED EMBODIMENTS OF THE INVENTION

Reference is now made to the accompanying drawings for a better understanding of the invention, in which all essential parts or elements are numbered and the same or similar numbers are employed to refer to the same or similar parts or elements throughout.

Figure 1:
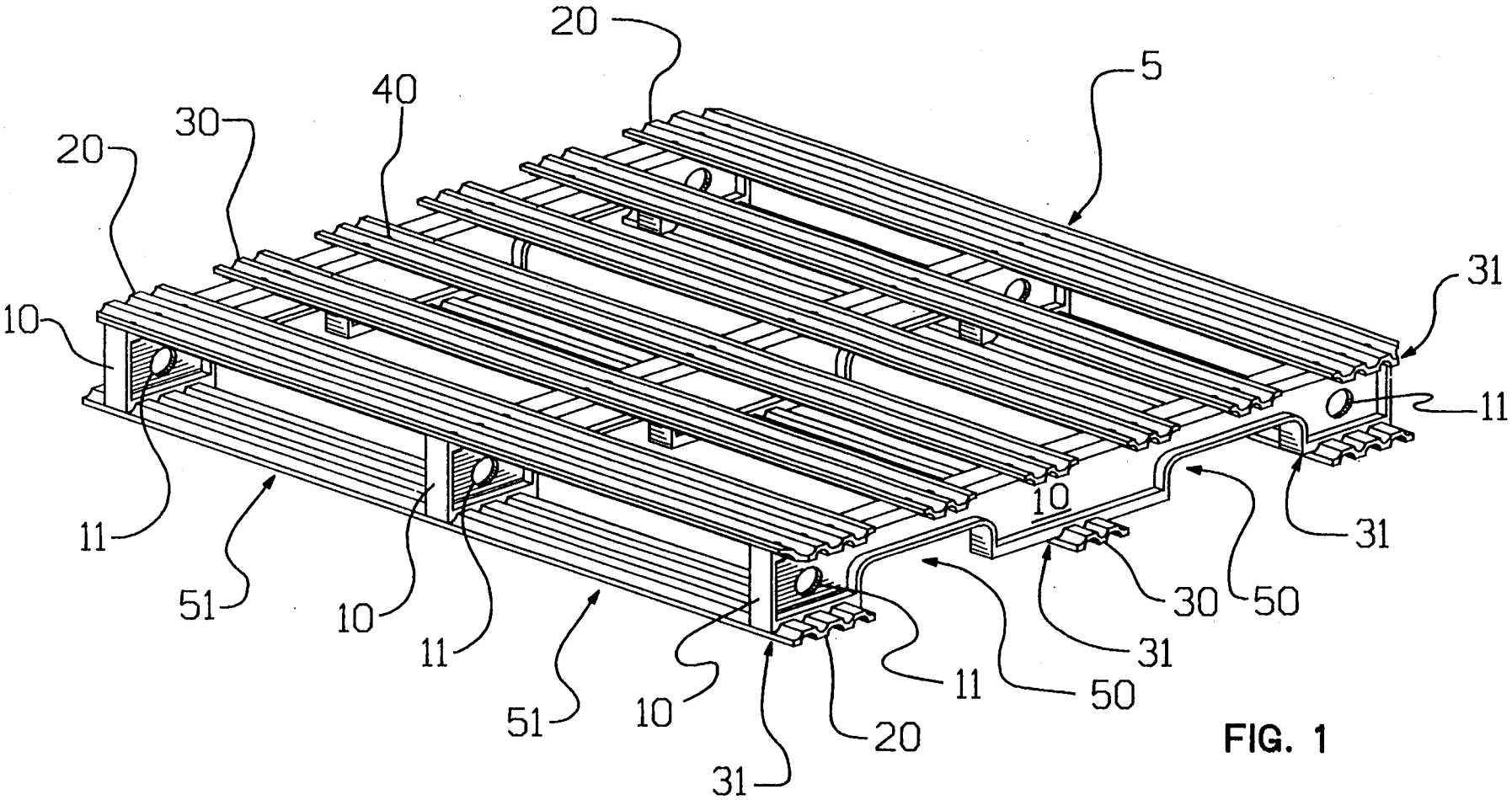
FIG. 1 is a perspective view of a typical rectangular pallet assembly of the invention.

Referring to FIG. 1, a typical pallet assembly of the invention is shown generally at 5 and comprises a plurality of spaced stringer, runner, or girder members 10 and coplanar corrugated deckboards 20 and 30 perpendicular to the stringers 10. Hereinafter the stringers 10 may be referred to as "transverse" and the deckboards 20 and 30 as "longitudinal", but it will be understood that these terms are used for convenience only, especially since pallets 5 are rectangular and are generally square or nearly so. The deckboards 20 and 30 and stringers 10 are formed from a synthetic polymer or plastic material and may be produced by any method known in the plastics-forming art, e.g., injection, extrusion, extrusion/compression, or rotational molding. To increase the strength to weight ratio or to reduce the weight and amount of plastics material required, stringer 10 or board 20 or 30 may be hollow or have through openings 11. Through-openings 11 may also be used as anchorages for load-securement using strapping, rope, or the like. Deck boards 20 and 30 are attached to stringers 10 by integral fastening means in the form of spikes or studs 40 which are molded into the stringers 10 and better seen in FIG. 2 and which are preferably securely but releasably secured within apertures 41 as shown in FIG. 2 (releasably—e.g., as by reheating of thermoplastic studs, or by pulling the elements 10, 20, and/or 30 apart, or by the employment of unscrewable securement screws (not shown) screwed into studs 40) so that the pallet can be readily disassembled.

As shown, deck board 20 is wider than deck board 30, although both can obviously be of the same width and selection or choice of deckboard widths is optional depending upon the circumstances and particularly upon the intended use of the pallet 5 involved. The components, namely the deckboards 20 and 30 and the stringers 10, are shown in mating engagement at 31, as will be more clear from the exploded views of FIG. 2. The interface connection at 31 may of course be further enhanced with suitable adhesive but the fastening means employed according to the invention are normally sufficient. At 40 is indicated an upset (i.e., heated and flattened) end of an integral deck board fastening stud 40, which again will be more clearly apparent from the exploded views of FIG. 2. At 50 are shown openings which are entryways for the forks of a lift truck or pallet jack whereas at 51 are indicated openings which are likewise entryways for the forks of a lift truck or similar apparatus.

Figure 2:
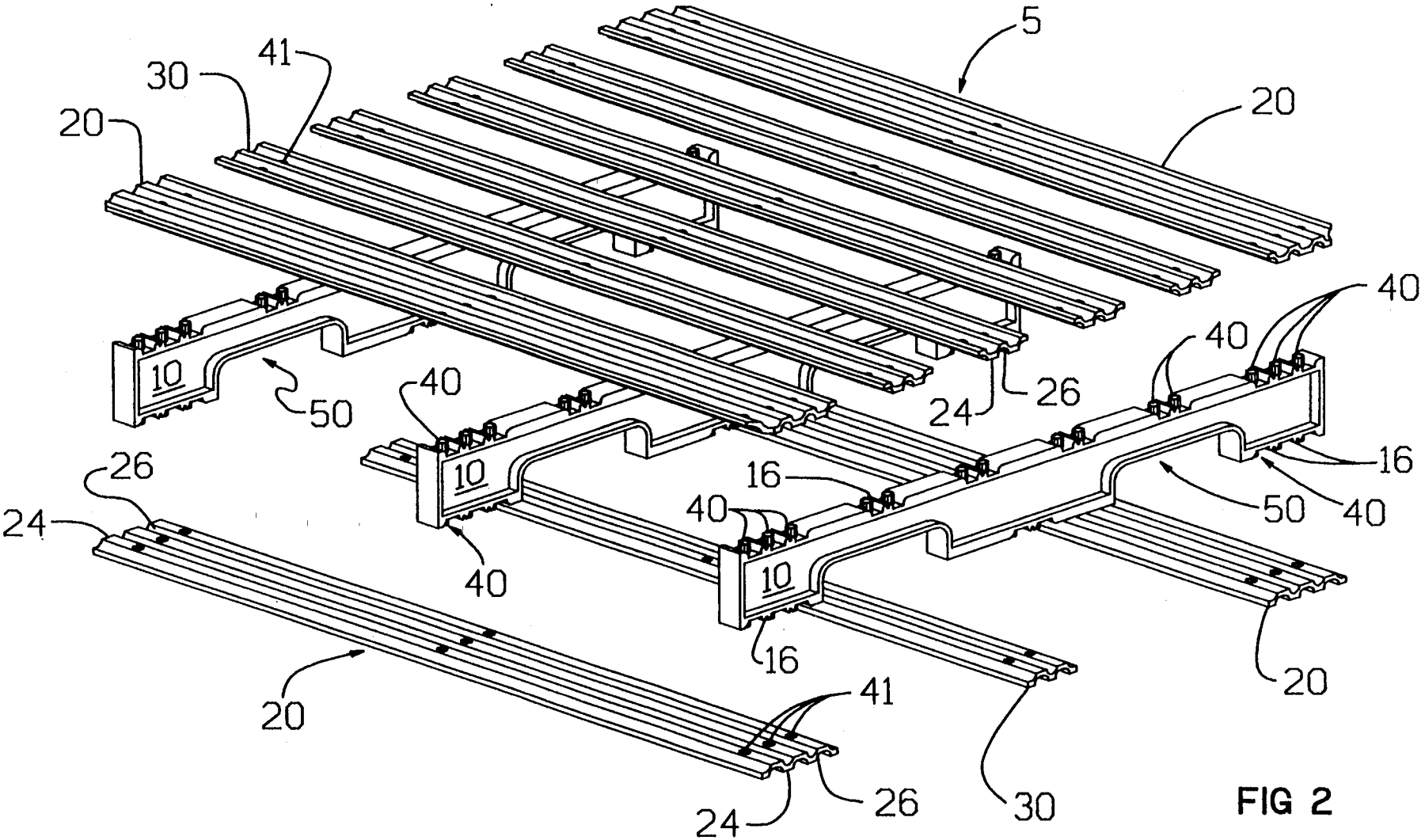
FIG. 2 is an exploded view of the pallet assembly of FIG. 1.

FIG. 2 shows an exploded view of the pallet assembly of FIG. 1, from which the mating engagement means between the deck boards 20 and 30 and the stringer members 10 are to be clearly seen. These comprise deck board fastening studs 40, as provided on the upper surfaces of stringers 10, as shown before insertion into apertures 41 in deck boards 20 and 30, which are designed to receive the integral fastening studs 40 which, upon insertion into apertures 41 and being upset or flattened out therein, provide secure mating engagement between stringers 10 and deck boards 20 and 30 as shown for example at 31 in FIG. 1. Stringers 10 are provided with protuberances 16 between studs 40, which protuberances 16 are designed and adapted to be received in channels 26 in deck board members between flat surfaces 24 of the corrugated deck board members 20 and 30.

As shown, the pallets 5 are assembled with deck boards 20 and 30 having flat surfaces 24 and channels 26 facing downwardly, so that upwardly-extending protuberances 16 are received in downwardly-opening channels 26 between studs 40 and upwardly-extending studs 40 are received in apertures 41 in deck boards 20 or 30. Alternatively, and or simultaneously, the same elements operate in reverse at the bottom of stringers 10 where downwardly-extending studs are received in apertures 41 and downwardly-extending protuberances 16 are received in upwardly-opening channels 26. In this manner, perfect mating engagement as at 31 in FIG. 1 is realized between studs 40 and apertures 41 as well as between upwardly-extending protuberances 16 between studs 40 and downwardly-opening channels 26 between downwardly-disposed flat surfaces 24 of deck boards 20 and 30. As is apparent, similar flat surfaces 24 and channels 26 appear in the upper surfaces of deck boards 20 and 30 and, due to the fact that apertures 41 are provided also in flat surfaces 24 on lower deck boards and since downwardly-extending studs 40 as well as downwardly-extending protuberances 16 therebetween are likewise provided on the lower or downward surfaces of stringers or runners 10, perfect mating engagement is also realized between the runner or stringer members 40 and bottom deck boards or footboards 20 and 30.

Figures 3, 4:
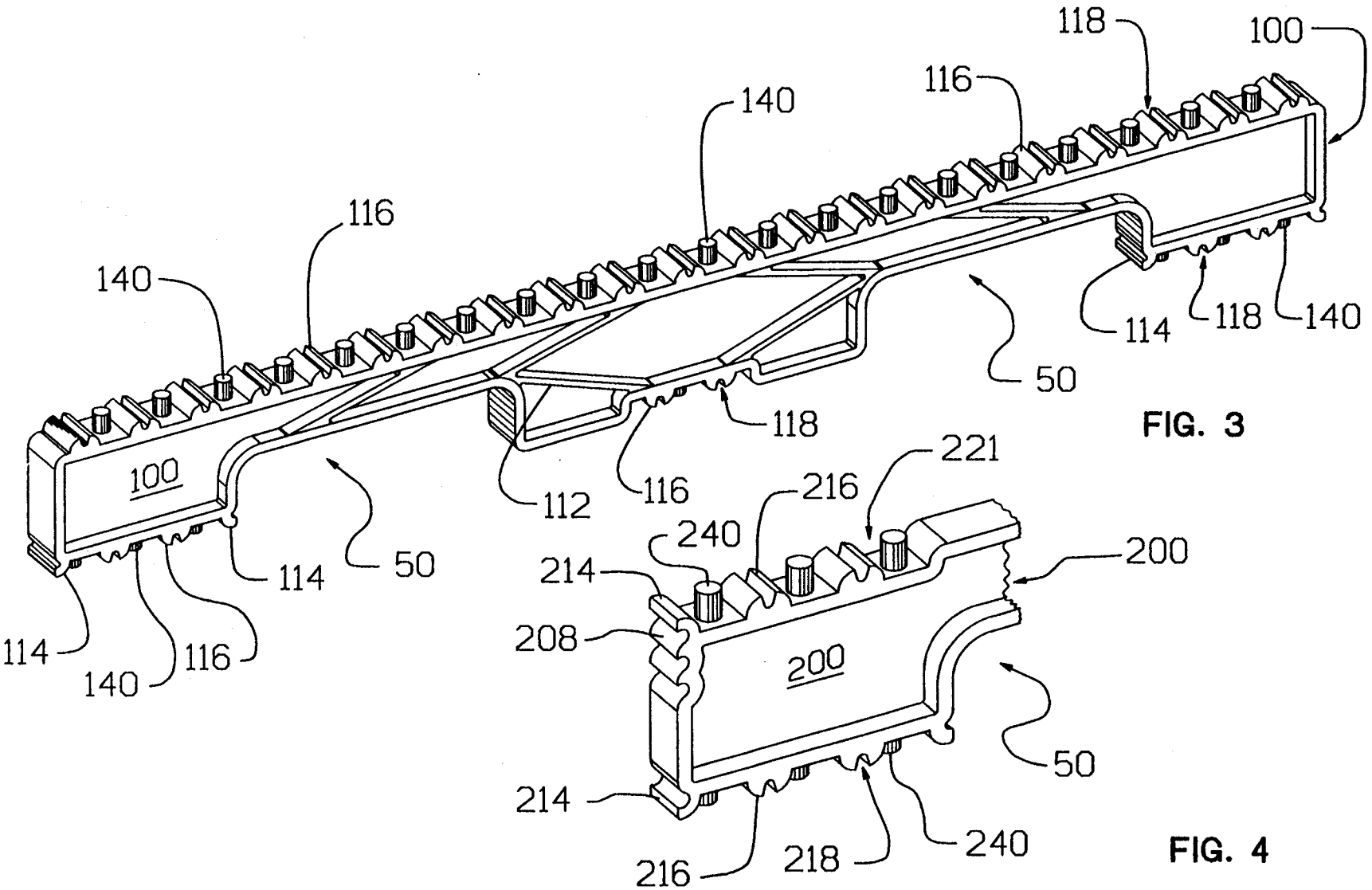
FIG. 3 is an enlarged perspective view of another embodiment of a stringer.
FIG. 4 is a partial enlarged perspective view of a further embodiment of a stringer.

Referring now to FIG. 3, which shows an enlarged perspective view of another embodiment of a stringer at 100, molded-in reinforcing rib 112 to resist bending under load is apparent, as well as certain other features including upwardly and downwardly extending integral deck board fastening studs 140, protuberances 116 to support and engage with corresponding features on a deck board such as channel or cavity 26 in the corrugated deck boards 20 or 30 in FIG. 2, slots 118 in protuberances 116 to allow rainwater or other liquid to drain from a deck board surface therethrough, and flanges 114 for supporting the edges of deck boards 20 and/or 30.

Referring now to FIG. 4, which is a partial enlarged perspective view of a further embodiment of a stringer 200, flanges 214 for supporting edges of deck boards 20 and/or 30 are apparent, as well as upwardly and downwardly extending integral deck board fastening studs 240, protuberances 216 on the stringer 200 for supporting and engaging with a corresponding feature on a deck board, for example, a cavity or channel 26 in deck boards 20 or 30, slots 218 in protuberances 216 to allow water or other liquid to drain from a deck board surface, and a flat surface 221 on the stringer upper surface adjacent fastening studs 240 where supplemental adhesive may be employed to advantage to resist shear loads between the pallet stringers and deck boards, and finally ridges 208 molded into the ends of pallet stringers 200 for use in conjunction with rope, usual plastic strapping, or with shrink/stretch wrap employed in unit load containment which engages with ridges 208 on the ends of the pallet stringers 200, thus to assist in preventing the wrapped load from separating from the pallet.

Figure 5:
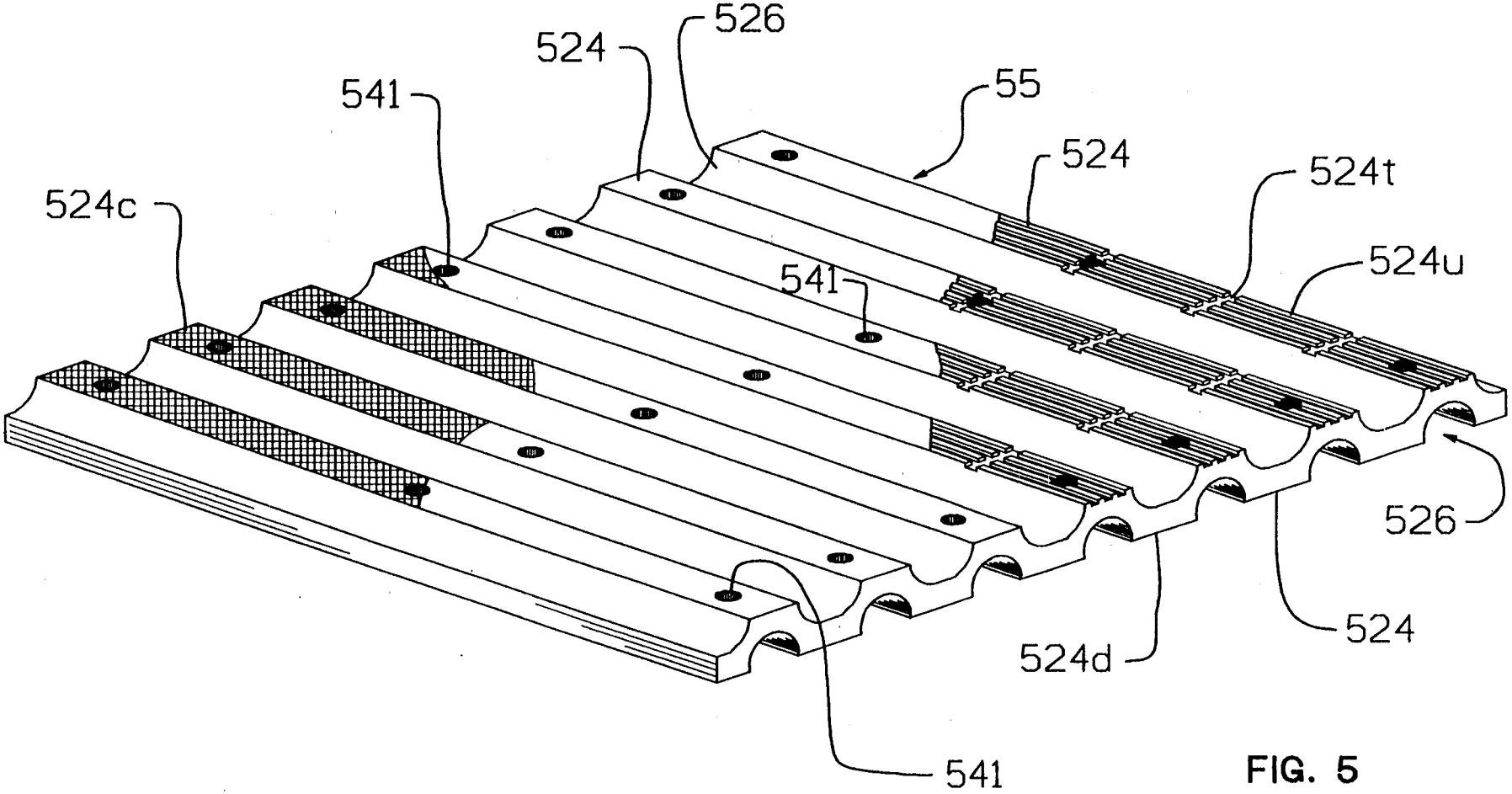
FIG. 5 is a perspective view of a more extensive embodiment of a deck board, namely, a single-sheet deckboard.

In FIG. 5 is shown a one-piece or single-sheet pallet deck board 55, molded in a size sufficient to function as the sole top or bottom deckboard of a pallet, corrugated to include upper and lower flat surfaces 524, and with corresponding channels or concavities 526 for engagement with protuberances on stringer members such as protuberances 16, 116, and 216 on stringers 10, 100, and 200 respectively. Deck board upper flat surface **524*u* may be molded with load-stabilization and airflow and drainage features such as checkering or further grooves and/or ridges, as well known in the art for minimizing product slippage during handling, such as shown at 524C, whereas the opposite and downward flat surface of the deck board 524*d* may be molded or rolled or otherwise provided with the same features or with another surface treatment to facilitate gripping or to enhance the performance of adhesives. When the upper flat surface 524*u* is provided with further e.g., longitudinal, grooves and/or ridges, additional e.g., transverse, depressions 524*t* may be provided for further load stabilization, airflow, and drainage purposes. Apertures 541 are employed in usual manner for engagement with integral deck board fastening studs such as 40, 140, or 240 for securement of the deck board 55 to an adjacent transverse stringer or stringers such as 10, 100, or 200. This FIG. 5 also well illustrates the vertical opposition of the flat surfaces 524 and the concavities 526, such vertical opposition facilitating the secure nesting of pallets when one pallet is stacked upon another as, for example, shown in FIG. 7**.

Figure 6:
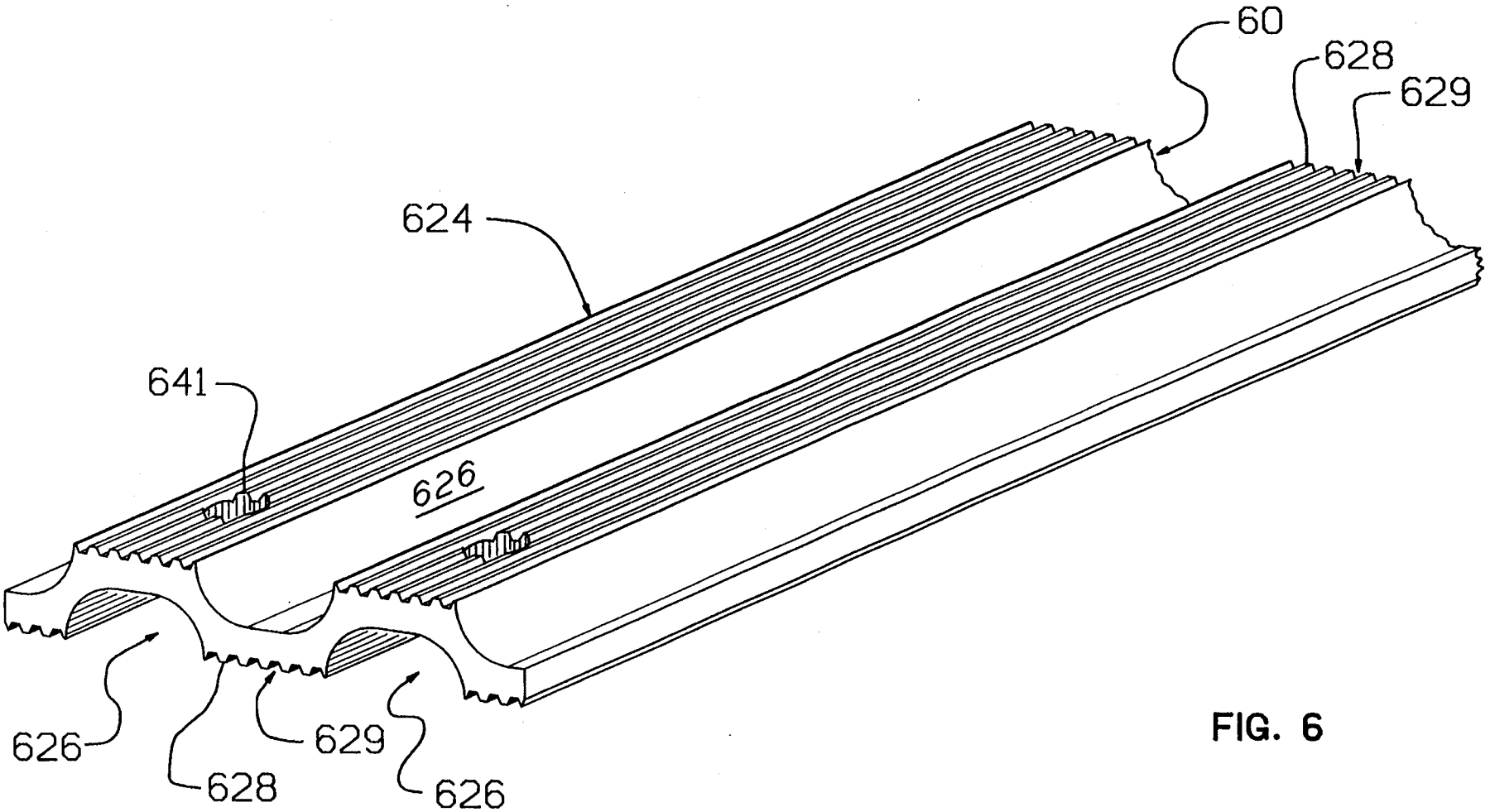
FIG. 6 is an enlarged perspective view of another embodiment of a deck board.

FIG. 6 shows another embodiment of a deck board at 60, which in this case is a narrow deck board with an asymmetric cross section and having concavities 626 to engage protuberances such as 16, 116, or 216 on adjacent stringers such as 10, 100, or 200 and flat surfaces 624, with stud-receiving apertures 641, to engage similar flat surfaces of deck boards on adjacent pallets. In this case the deck board flat surfaces 624 have ridges 628 and grooves 629 molded therein to enhance air flow between the pallet deck boards 60 and the supported product. This FIG. 6 also well illustrates that concavities 626 are vertically opposed to flat surfaces 624, that is, the longitudinal flat strip areas and channels or concavities of the top and bottom surfaces of the deckboard member lie in vertically opposed relation to each other.

Figure 7:
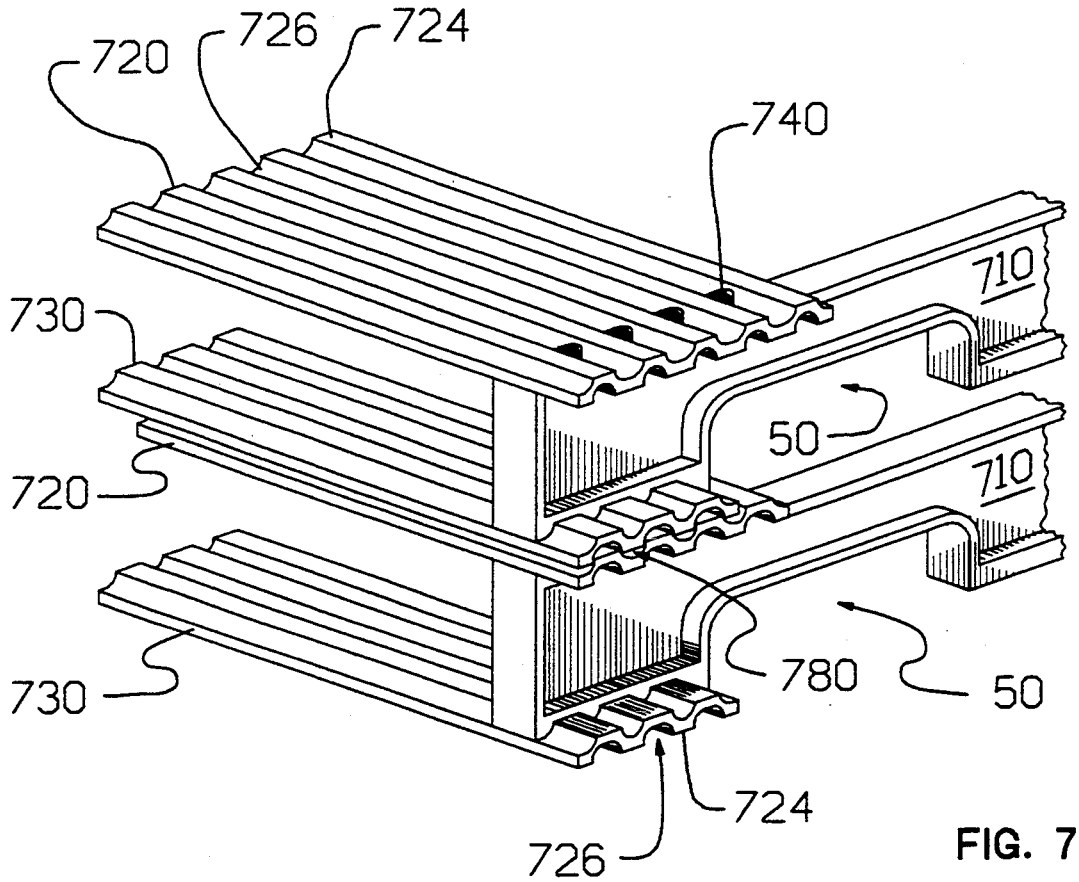
FIG. 7 is a partial perspective view of two pallets of the invention shown in a normal stacked position.
Figure 8:
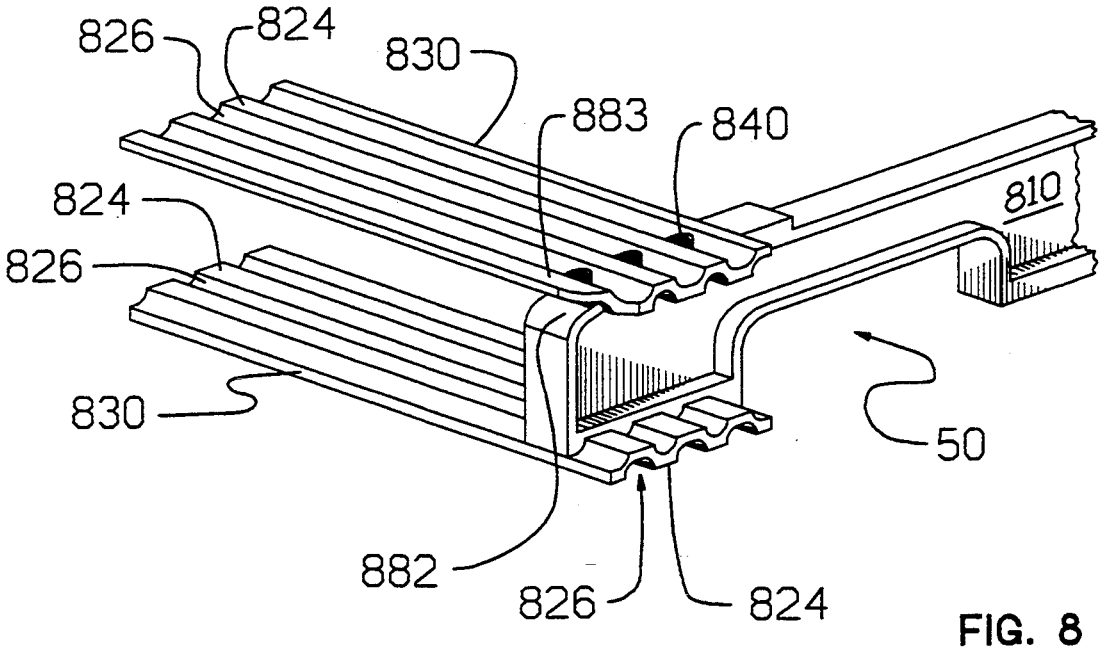
FIG. 8 is a partial perspective view of another embodiment of a pallet deck board and runner arrangement or assembly according to the invention.

FIG. 7 shows a partial perspective view of two pallets in normal stacked position and FIG. 8 shows a partial perspective view of another pallet deck board and runner arrangement or assembly according to the invention. In FIG. 7, the runner or stringer member 710 is attached to corrugated or waffled wide and narrow deck boards 720 and 730 by means of integral deck board fastening studs 740 on the top and bottom surfaces of stringer 710 received in apertures 741 (not shown) in deck boards 720 and 730. Concavities or channels 726 are provided in deck boards 720 and 730 for reception of protuberances therein such as protuberances 216, 116, or 16 on stringers 200, 100, or 10 of FIGS. 4, 3, or 2, respectively. Wide deck board 720 is shown supporting narrow deck board 730 in mating engagement 780 between the stacked pallets, with flat feature or surface 724 of deck board 730 engaged in and supported by concave or channel feature 726 of underlying deck board 720.

In FIG. 8, deck board 820 and deck board 830, being identical deck boards but with opposite vertical orientation to facilitate pallet nesting, each with flat surfaces 824 and concavities or channels 826, are affixed to stringer 810 by means of integral deck board fastening studs 840 secured in apertures 841 (not shown) of the respective deck boards 820 and 830. Usual concavities or channels 826 exist intermittently with flat deck board surfaces 824 for purposes of receiving and engaging protuberances on stringer members 810 or, in the absence of protuberances, flat surfaces 824, for resting in sliding or mating engagement with corresponding flat surfaces or concavities of deck boards of adjacent overlying or underlying pallets. In this case, upper deck board 820 appears to be upwardly-angled at its outer longitudinal edge 883 because stringer 810 is provided with a rounded upper corner 882, thereby providing the pallet assembly with a rounded stringer corner at which the deckboard and the stringer top surface do not overlap, and thereby likewise providing anchoring means and minimizing the likelihood of puncture of a shrink/-stretch wrap system which may conveniently be provided around the load by engagement of such shrink/-stretch wrap within the gap provided between deckboard edge 883 and stringer rounded corner 882. Rounded corner configuration 882 of stringer 810 is conveniently provided by an appropriate mold configuration which eliminates a flange, such as 114 or 214 on stringers 100 and 200 respectively, thereby to provide with deckboard edge 883 a gap for engaging the shrink/stretch wrap of a load-binding system of which it is a part and/or a usual tie-down feature such as a rope, plastic strapping, or the like.

Figure 9:
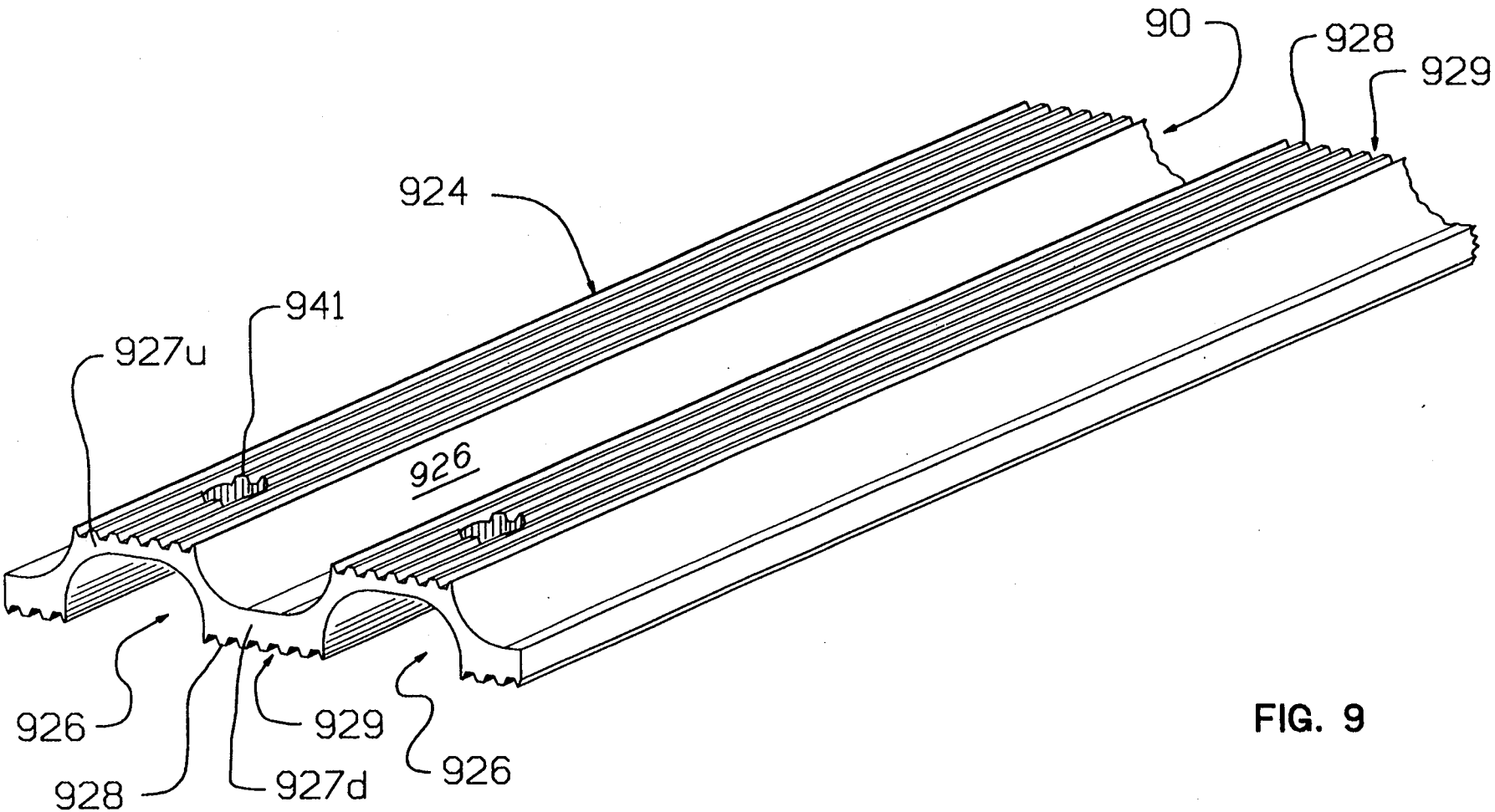
FIG. 9 is like FIG. 6 showing another deckboard embodiment wherein the deckboard is of non-uniform cross-sectional area.

FIG. 9 shows a deckboard in all respects like the deckboard of FIG. 6, except that the deckboard is of non-uniform and asymmetric cross-sectional area. As will be noted, the upper portion of the deckboard has a thinner longitudinally-extending flat strip at 927*u* and a thicker longitudinally-extending flat strip on the opposite side of the deckboard at 927*d*, it thus being possible by the use of a deckboard of FIG. 9 to reduce the overall weight of a pallet embodying the same while retaining essential load-bearing characteristics.

Particular features of the pallets of the invention, as will be noted, include the fact that the deck boards are corrugated, e.g., formed with an asymmetric, waffled, or corrugated cross section to maximize bending strength, as previously described. Such deck boards may be manufactured or produced in any suitable manner, as by continuous extrusion or injection molding. Moreover, the material of construction of the deckboards may be any polymer or polymer blend processed into an engineering-grade polymer, the use of at least a percentage of reclaimed plastic being preferred, with olefins, polyethyleneterephthalate (PET), polycarbonate, and acrylonitrile-butadiene-styrene (ABS) being usual polymeric materials of construction. If desired, the deck boards may contain reinforcements which are preferably biaxially oriented and which are introduced at the time of manufacture, such as fiberglass, rovings and the like, for greater strength. The deck boards may be provided in various board widths and sections to suit the particular application intended, and the stick-built design of the pallets of the invention is to be noted as atypical for molded plastics manufacture.

The runners or stringers employed as an integral part of the pallets of the present invention are formed with integral deck board seats at predetermined locations along the top and bottom surfaces thereof and with integral board fastening means in the form of integral spikes or studs which pass through corresponding apertures in the deck boards, as already pointed out. The runners or stringers may be formed or produced in any suitable manner, such as by extrusion, preferably by continuous extrusion plus compression or injection molding, or by extruding into preforms and then transferring to a die set while hot for final formation and cooling, although injection molding alone is satisfactory and is standard practice in the art.

As already noted, the flat surfaces of the deck boards may be provided with non-skid surface characteristics, as conveniently achieved by texturing or checkering during a rolling process of their formation.

For securing the deck boards to the runners according to the invention, numerous fastening methods are available and may be employed. The preferred method is hot upset of the integral spikes or studs after insertion within and through corresponding deck board apertures. Another method of securement involves the employment of a mechanical screw in the spike or stud or the employment of a hollow spike or stud and use of a drive rivet to cap the spike after insertion into and through the corresponding aperture in the deck board. Finally, supplemental adhesive may be employed as a safety factor, is generally recommended for such reason, and is ordinarily applied at the flat surfaces adjacent to the integral spikes or studs and protuberances provided on the upper and lower surfaces of the runners, as already pointed out.

As will be noted, the pallets of the present invention nest with each other or slide atop one another depending upon which side and portion of the lower deck board or footboard is placed into juxtaposition with an underlying pallet deck board. This is dependent upon which side of the asymmetrically-sectioned deck board is applied at the top and at the bottom of the stringer or runner, especially when one of the deck boards employed has a checkered or non-skid surface on longitudinally-extending flat segments thereof. Depending upon whether it is desired that the pallets nest with each other when loaded one upon another or slide with respect to each other, it is a simple matter to select the deck board surfaces to be outwardly disposed on the upper deck board and on the lower deck board or footboard, as it is commonly referred to.

From the foregoing, it is seen that the pallet of the invention, in its various and variable embodiments and adaptations, is conveniently versatile and adaptable to the shipment of innumerable objects with equal facility, and that the precise structure of a pallet of the invention can be varied at will to suit the needs of even the most demanding and discriminating shippers.

It is accordingly seen from the foregoing that the present invention provides a highly desirable and advantageous pallet, having all the aforementioned characteristics and advantages, and whereby all of the stated objectives of the invention, and more, are attained.

It is to be understood that the present invention is not to be limited to the exact materials, structures, procedures, arrangements, or assemblies disclosed as numerous modifications and changes therein will immediately become apparent to one skilled in the art to which the present invention pertains, wherefore the present invention is to be understood as limited only by the full scope which can be legally accorded to the appended claims.

We claim:

1. A plastic essentially rectangular modular pallet assembly, the parts of which are also modular, comprising front and rear vertical transverse stringer members and top and bottom horizontal longitudinal deck board members having alternating longitudinally-extending flat strip areas and longitudinally-extending channels or concavities on the top and bottom surfaces thereof, wherein the longitudinal flat strip areas and channels or concavities of the top and bottom surfaces of deck board members lie in vertically opposed relation to each other, said stringers comprising, on upper and lower deck board abutting surfaces thereof, integral deck board fastening studs, top and bottom deck board members having apertures therein in the flat surface strip areas thereof near the ends thereof which are adapted to receive said deck board fastening studs, said deck board fastening studs being received in said apertures and secured therein, said front and rear stringers of said pallet having openings therein adapted to receive the prongs of a lift truck or pallet jack therein: wherein said stringers comprise, on upper and lower surfaces thereof and adjacent said integral deck board fastening studs, integral protuberances adapted to support, engage, and be received by corresponding longitudinally-extending channels or concavities in said deck board located adjacent to and between said longitudinally-extending flat surface strip areas thereof, and wherein said protuberances support, engage, and are received in said corresponding channels or concavities.

2. A pallet of claim 1, wherein the pallet has an intermediate stringer as well as front and rear stringers and wherein the sides of said pallet provide space for the insertion of the prongs of a lift truck or pallet jack therein between the stringers and between the top and bottom deck boards of said pallet.

3. A pallet of claim 1, wherein pallet stringers comprise apertures therein for weight reduction and for the reception of load-securing tiedown means therein.

4. A pallet of claim 1, wherein ridges are provided in vertical ends of pallet stringer members to provide a means of engagement of said stringer members with load-binding means or wrap.

5. A pallet of claim 1, wherein said protuberances comprise slots therein to facilitate fluid drainage from deckboards adjacent thereto.

6. A pallet of claim 1, wherein top and bottom deck board members have surfaces thereof in mating engagement with surfaces of stringer members by means of said integral deck board fastening studs in surfaces of said stringer members and stud receiving apertures in flat longitudinal surface areas of said deck board members.

7. A pallet of claim 6, wherein said mating engagement means includes protuberances adjacent said integral deck board fastening studs on stringer members and corresponding protuberance-receiving concavities or channels in the abutting surfaces of deck board members.

8. A pallet of claim 7, wherein protuberances on surfaces of said stringer members adjacent said integral deck board fastening studs comprise slot means to permit rain water or other liquid to drain from the surface of a deck board adjacent thereto.

9. A pallet of claim 1, wherein said studs are securely but releasably secured within said apertures so that the pallet can be readily disassembled.

10. A pallet of claim 1, wherein stringer members include flange members at upper corners thereof for supporting edges of deck boards secured thereto.

11. A pallet of claim 1, wherein similar pallets stacked upon each other are in sliding engagement with each other by virtue of longitudinally-extending flat surface strip areas of deck board members supported by corresponding longitudinally-extending flat surface strip areas of deck board members of an underlying pallet.

12. A pallet of claim 1, wherein a plurality of deck boards are employed as a top or bottom pallet surface and are located in spaced relation to each other.

13. A plastic modular pallet-forming deckboard, adapted to become a horizontally-disposed longitudinal top or bottom pallet deck board member in a pallet formed therefrom, having alternating longitudinally-extending flat strip areas and longitudinally-extending channels or concavities on the rod and bottom surfaces thereof, wherein the longitudinal flat strip areas and channels or concavities of the top and bottom surfaces of the deck board lie in vertically opposed relation to each other, and having apertures therein in the flat surface strip areas thereof near the ends thereof which are adapted to receive integral deck board fastening or securing studs on both upper and lower surfaces of vertically adjacent transverse stringer members of a pallet formed therefrom; and wherein said longitudinally-extending channels or concavities in said deck board located adjacent to and between said longitudinally-extending flat surface strip areas thereof are adapted to engage, receive, and be supported by corresponding integral protuberances located on said upper and lower surfaces of said stringers adjacent the integral deckboard fastening studs thereof.

14. A plastic modular pallet-forming stringer, adapted to become a vertically-disposed transverse front, back, or intermediate pallet stringer member in a pallet formed therefrom comprising, on upper and lower surfaces thereof, which are adapted to abut deckboards in a pallet formed therefrom, integral deckboard fastening or securing studs, which are adapted to be received and secured in apertures in longitudinally-extending flat surface strip areas of deckboards near the ends of said deckboards in a pallet formed therefrom, said stringer having openings therein adapted to receive the prongs of a lift truck or pallet jack therein; and wherein said stringer comprises, on upper and lower surfaces thereof and adjacent said integral deck board fastening studs, integral protuberances adapted to support, engage, and be received by corresponding longitudinally-extending channels or concavities on top and bottom surfaces of said deck boards located adjacent to and between said longitudinally-extending flat surface strip areas thereof.

* * * * *

UNITED STATES PATENT AND TRADEMARK OFFICE

CERTIFICATE OF CORRECTION

PATENT NO. : 5,440,998

DATED : August 15, 1995

INVENTOR(S) : Robert L. Morgan, IV , Michael D. Monfore

It is certified that error appears in the above-indentified patent and that said Letters Patent is hereby corrected as shown below:

Column 14, line 13; "rod and bottom" should read
-- top and bottom --

Signed and Sealed this

Thirty-first Day of October 1995

*Attest:*

*Attesting Officer*

BRUCE LEHMAN

*Commissioner of Patents and Trademarks*